United States Patent [19]

Spencer, III et al.

[11] Patent Number: 4,979,568

[45] Date of Patent: Dec. 25, 1990

[54] ANNULUS FLUID PRESSURE OPERATED TESTING VALVE

[75] Inventors: Harold A. Spencer, III, Missouri City; Robert R. Green, Houston, both of Tex.

[73] Assignee: Baker Hughes Incorporated

[21] Appl. No.: 465,509

[22] Filed: Jan. 16, 1990

[51] Int. Cl.[5] ..... E21B 34/10; E21B 49/08

[52] U.S. Cl. ..... 166/374; 166/321; 166/323; 166/331; 166/386

[58] Field of Search ..... 166/374, 386, 321, 323, 166/331, 332, 324

[56] References Cited

U.S. PATENT DOCUMENTS

| | | | |
|---|---|---|---|
| Re. 29,638 | 7/1976 | Nutter | 73/151 |
| 3,856,085 | 12/1974 | Hoblen et al. | 166/324 |
| 3,976,136 | 8/1976 | Farley et al. | 166/374 |
| 4,125,165 | 11/1978 | Helmus | 166/323 |
| 4,293,038 | 10/1981 | Evans | 166/331 |
| 4,537,258 | 8/1985 | Beck | 166/331 |
| 4,569,397 | 2/1986 | Brakhage, Jr. et al. | 166/374 |

*Primary Examiner*—Bruce M. Kisliuk

*Attorney, Agent, or Firm*—Jackson & Walker

[57] ABSTRACT

A method and apparatus for operating a ball valve in a test tool string for a subterranean well, including a tubular actuator for the ball valve which is movable from a closing position of the ball valve to an opening position and beyond the opening position to a lock setting position, preventing the return of the tubular actuator to the ball valve closing position until the cycle of additional movements of the tubular actuator is accomplished. A metal-to-metal seal is provided for the ball valve and a larger than normal biasing force derived from a spring and a trapped pressurized gas is applied to the tubular actuator in its valve position to insure the integrity of the metal-to-metal seal.

10 Claims, 11 Drawing Sheets

ANNULUS FLUID PRESSURE OPERATED TESTING VALVE

BACKGROUND OF THE INVENTION

1. Field of the Invention:

This invention relates to a testing valve insertable in a well conduit, such as a drill string, and operable by an increase in annulus pressure to shift the valve from a closed to an open position and vice versa.

2. Summary of the Prior Art:

The incorporation of a testing valve in a drill string utilized for drilling a subterranean well to effect the testing of various formations traversed by the well bore, is an expedient well known in the art. Reissue Patent 29,638 to NUTTER discloses one form of test tool heretofore utilized, involving a sleeve valve which is axially shifted between a bore opening and a bore closing position by an increase in the annulus pressure above a set packer over the hydrostatic pressure normally existing in the well annulus. The NUTTER Reissue Patent employs a nitrogen chamber to provide a reference pressure, which is substantially equal to the well annulus hydrostatic pressure. The reference pressure in the nitrogen chamber is produced by permitting well annulus fluids to enter an extension of the nitrogen chamber and impinge upon a floating piston which isolates the nitrogen gas from the well fluids. When the packer is set, and it is desired to establish a reference pressure, an isolation valve is closed, cutting off the access of the well fluids to the extension chamber below the floating piston and, thus, trapping a pressure in the compressible nitrogen gas substantially equal to the well hydrostatic pressure. Such valve is then closed by a downward manipulation of the tubing string.

Later patents, such as Patent 3,976,136 to FARLEY et al, eliminated the necessity of closing the isolation valve by tubing string manipulation through the provision of an isolation valve operable by the initial increase in pressure of the well annulus fluids over the hydrostatic pressure existing at the time the packer is set. The FARLEY et al patent also discloses the employment of a rotatable ball valve as the valve element for controlling flow of formation fluid through the tubing string in which the testing tool is mounted. The ball valve has become the most popular version of pressure-operated testing tools now available.

The operation of such ball valve involves certain specific requirements if optimum, trouble free operation is to be achieved. A tubular member is commonly employed for effecting the shifting of the ball valve from a normally closed position to an open position by downward movement of the tubular member produced by an increase in the pressure of annulus fluids. Such tubular member generally defines part of the axial passageway through the tool which communicates with the bore of the tubing string carrying the testing tool and is slidably mounted within an outer housing. Thus, the maintenance of a good sealing relationship between the top of the tubular member and the closed ball valve is a necessity. At the same time, it is highly desirable that the seal between the ball valve and the tubular operating member be broken to equalize pressure above and below the valve prior to any shifting movement of the ball valve from its normally closed to an open position. This requirement has resulted in a number of different constructions in the prior art for utilizing separate annular sealing members telescopically related to the upper end of the tubular actuating member and biased by a small spring into sealing engagement with the ball surface when the ball is in its closed position. A lost motion connection is then provided between the upper part of the tubular actuating member and the annular member which actually engages the external periphery of the ball valve, to effect its rotation from closed top open position by downward movement of the tubular actuating member.

The aforedescribed prior art arrangement, while effective, has proven to be deficient when utilizing elastomeric seals on the ball valve, and whenever a substantial fluid pressure differential exists above the closed ball valve relative to the fluid pressure existing below the ball valve. Such fluid pressure differential tends to move the annular sealing member away from the ball valve and thus destroy the elastomeric seal by fluid jet action. If the ball is rotated while the seal is engaged, the elastomeric seal is readily disintegrated.

Lastly, prior art ball valves for test tools are normally run into and pulled from the well in a closed position and must be closed at any time that pressure cannot be maintained in the annulus. This closed position limits certain desired circulating and well killing procedures. Also this closed position requires the well fluids to bypass the entire apparatus being run into the well, including the packer mounted on the tool string. This necessarily slows the introduction of the apparatus into the well by virtue of the constricted upward passage for well fluids defined between the periphery of the unset packer and the well bore.

Accordingly, it is an object of this invention to provide an annulus pressure operated test tool, and method for operating same, which will overcome the aforementioned deficiencies and/or limitations of prior art apparatus.

SUMMARY OF THE INVENTION

The present invention relates to an improved test tool for incorporation in a tubular string which carries either a packer on its lower portion, or a seal assembly for stabbing into a permanent packer previously set in the well, for releasably sealably engaging the interior of a well bore at a region immediately above the formation to be tested. The test mechanism is contained within an elongated tubular housing and the operating valve of the test mechanism is preferably of the hollow ball type which is pivotally mounted in the tubular housing for movement between closed and open positions relative to the bore of the hollow housing. The closed position makes a metal sealing surface on the ball engagable with a metal end surface of a valve sleeve which is axially shifted relative to the ball by a tubular actuating member. No elastomeric seal is utilized to seal the ball in its closed position, which is a unique feature in a test tool valve.

A tubular actuating assemblage is slidably mounted within the bore of the tubular housing. The upper part of the actuating assemblage provides a mounting mechanism for diametrically spaced, internally projecting pins which respectively engage external slots formed in the periphery of the ball valve to effect the rotation of the ball valve between closed and open positions in response to axial movement of the aforementioned upper part of the tubular actuating assemblage.

Downward movement of the tubular actuating assemblage will effect first, the separation of the metal sealing surfaces and then the pivotal movement of the ball valve from a closed to an open position.

A lower portion of the tubular actuating assemblage defines an annular fluid pressure chamber in cooperation with the inner wall of the tubular housing. A radially enlarged piston shoulder is mounted on the exterior of such lower portion of the tubular actuating assemblage and is slidably and sealably mounted in the aforementioned annular fluid pressure chamber. Fluid pressure existing in the annulus surrounding the exterior of the tubular housing is supplied through a radial port in the tubular housing to the upper face of the piston shoulder, while the lower face of the piston shoulder is exposed to pressure derived from a compressible fluid medium, such as nitrogen gas. Fluid pressure of the nitrogen gas is determined in a second annular fluid pressure chamber disposed in the valve housing substantially below the first mentioned annular fluid pressure chamber and in which an annular floating piston is mounted to provide separation between the compressible fluid medium and the well fluids contained in the bore of the tubular housing. Prior to setting of the packer, the pressure of these fluids is substantially identical to the hydrostatic pressure of the fluid in the annulus surrounding the tubular housing.

An isolating valve is provided which, after setting of the packer, moves in response to a differential between the annulus fluid pressure above the packer and the fluid pressure existing in the bottom end of the bore of the tubular housing, which is normally the hydrostatic fluid pressure. Such isolation valve moves to a locked position closing the bottom of the second annular fluid pressure chamber, thus trapping a reference fluid pressure in the compressible fluid medium which can be substantially higher than the hydrostatic pressure existing in the well exteriorly of the tubular housing. In accordance with the method of this invention, such differential pressure is on the order of 700 to 1000 p.s.i., thus imposing a substantial upward biasing force on the tubular actuating assemblage, hence on the metal-to-metal ball seal.

A further increase in the pressure of fluids in the annulus surrounding the tubular housing will move the piston shoulder downwardly and the tubular actuating assemblage. A heavy spring is provided opposing the downward movement of both upper part of the tubular actuating assemblage and the lower part of the tubular actuating assemblage. Thus, the ball valve is always biased to its closed position, providing a fail safe closing if the annulus pressure is not maintained for any reason.

The pin and slot connection between the top end of the tubular actuating member and the ball valve is designed so that the slot is open at both ends, permitting the pin to pass out of the slot after downward movement of the tubular actuating member to its valve open positiOn, thus permitting further downward movement of the tubular actuating member to a third position which will be referred to as the lock setting position. This additional downward movement is another unique feature of this invention.

The lower portion of the lower part of the tubular actuating assemblage is provided with a plurality of peripherally spaced external locking lugs. A locking sleeve is mounted in the tubular housing for angular displacement relative thereto and such sleeve defines an equal plurality of internal peripherally spaced locking lugs. A pin and slot connection is provided between the locking sleeve and the lower portion of tubular actuating assemblage so that when the actuating assemblage is moved past the valve open position toward the afore mentioned lock setting position, the locking sleeve is angularly indexed to permit the external locating lugs on the tubular actuating assemblage to freely pass between the internal locking lugs on the locking sleeve. If the annulus pressure is then slightly reduced to permit upward return movement of the tubular actuating member, the locking sleeve is further indexed by the pin and slot connection to the tubular actuating member to move angularly so that the internal lugs are respectively aligned in the path of the external lugs, and the tubular actuating member is prevented from moving upwardly beyond the valve open position. Thus, the ball valve is locked in an open position for run-in, removal or other operations not requiring the ball valve to be closed. Such position will be referred to as the lock open position.

To release the lock, the pressure of the fluids in the annulus exterior of the tubular housing is increased to move said piston, hence said tubular actuating assemblage downwardly to what may be called the valve open-fail safe position. A subsequent decrease in the pressure of annulus fluids external to the tubular housing will permit the piston, and hence the tubular actuating assemblage to move upwardly, and the pin and slot connection makes a further angular index of the locking sleeve so that the external lacking lugs on the tubular actuating assemblage pass freely between the internal locking lugs on the locking sleeve. Thus, the tubular actuating assemblage will be returned to its uppermost valve closing position, wherein the ball valve is rotated to a fully closed position, under the combined bias of the spring and the trapped fluid pressure respectively operating on the tubular actuating assemblage.

The aforedescribed lock open feature is of particular value during certain run-in procedures and well killing procedures incorporating the valving apparatus of this invention. At the well head, and prior to run-in, fluid pressure from a charged cylinder of gas, a compressor or pump, may be applied through the port in the tubular housing to drive the piston and tubular actuating assemblage downwardly and effect the downward movement of the tubular actuating assemblage from the valve closed position down to the lock setting-valve open position. A reduction in such applied fluid pressure will permit the upward movement of the tubular actuating assemblage to engage the external lugs thereon with the internal lugs of the locking ring and thus lock the ball valve in its lock open position for insertion in the well. This permits the fluids in the well to pass readily up through the bore of the tubing string upon which the testing apparatus is suspended and greatly facilitates the entry of the testing apparatus into the well and more specifically, the inserting of seal assemblies into previously set permanent packers.

After the testing apparatus is positioned at its desired location with respect to the formation to be tested, or a seal assembly landed, the packer may be set in conventional fashion and the pressure of fluids in the well annulus above the set packer is increased to again drive the tubular actuating member downwardly to the valve open-fail safe position. A reduction in such annulus pressure then permits the tubular actuating member to return from the valve open-fail safe position, pass through the internal locking lugs of the locking sleeve, and proceed upwardly to its valve closed position by the combined bias of the previously mentioned spring and the trapped gas pressure.

In other words, the locking of the tubular actuating member in its valve opening position is accomplished by a cyclic axial movement of the tubular actuating member from its valve closed position to and through the valve open position and then by a return movement to the locked open position. To effect the unlocking of the tubular actuating member, the down and up reciprocation of the tubular actuating member is repeated, only the tubular actuating member is then free to move upwardly to its valve closed position. Thus, an increase in annulus fluid pressure above that required to effect the opening of the ball valve, followed by a decrease in such fluid pressure shifts a lock to secure the tubular actuating member in a lock open position; similarly, a subsequent increase in annulus fluid pressure will move the ball valve actuating member to its valve open fail-safe position; then a decrease in annulus fluid pressure effects the unlocking of the tubular actuating member and the movement of the ball valve from its valve open-fail safe position to its closed position.

As previously mentioned, a further feature of this invention lies in the provision of an annular metallic sealing member mounted adjacent the top end of the tubular actuating assemblage, which is engagable with an annular metallic sealing surface provided on the exterior of the ball valve when the ball valve is in its closed position. Since the pins controlling the position of the ball valve can move out of their cooperating cam slots after the ball valve has been shifted to its fully closed position, the tubular actuating assemblage continues upwardly past the fully closed position of the ball valve to bring the annular metallic sealing surface on the upper end of the tubular actuating assemblage into firm engagement with the annular sealing element provided on the exterior of the closed ball valve. This arrangement has the advantage that when it is desired to open the ball valve and the tubular actuating assemblage is moved downwardly to effect such opening movement, the initial movement of the tubular actuating assemblage separates the metallic sealing elements carried by the tubular actuating member and the ball valve and equalizes any fluid pressure differential that may exist across the closed ball valve prior to the initiation of any turning movement of the ball valve from its closed position. With the seal removed from the ball, no high forces are required to rotate the ball. Further downward movement of the upper part of the tubular actuating assemblage brings the ball valve rotating pins into engagement with the open ends of the cam slots on the ball valve and effects the rotation of the closed ball valve to its open position.

Still another feature of this invention lies in the provision of means for maintaining the metallic sealing surfaces on the tubular actuating member and the ball valve in firm sealing engagement irrespective of the existence of either an upward or downward fluid pressure differential force on the closed ball valve. The upper portion of the tubular actuating assemblage cooperates with the bore of the tubular valve housing to define a third annular fluid pressure chamber. Such third annular fluid pressure chamber is open at its top and in fluid communication with fluid pressures existing above the closed ball valve. A port is provided through the wall of the upper portion of the tubular acutating assemblage, thus providing fluid communication between the fluid pressure existing below the closed ball valve and the third annular fluid pressure chamber.

A floating sleeve piston is slidably and sealably mounted in the third annular fluid pressure chamber and is constructed so as to separate the fluid pressures derived from above the closed ball valve from the fluid pressures derived below the closed ball valve. The floating piston has an opposing mechanical connection in an upward direction with the upper portion of the tubular actuating assemblage so that when the fluid pressure below the closed ball valve is higher than the fluid pressure above the closed ball valve, no additional sealing force is generated by the floating piston. When, however, the fluid pressures above the closed ball valve are in excess of the fluid pressure below the closed ball valve, the structure of the exterior of the upper portion of the tubular actuating assemblage defining the inner wall of the third annular fluid pressure chamber in conjunction with the structure of the interior of the floating piston defining the outer wall of the third annular fluid pressure chamber, is such that the total area of the downwardly facing surfaces of the floating piston exposed to fluid pressures above the closed ball exceeds the areas of the upwardly facing surfaces of the upper part of the tubular actuating member exposed to such fluid pressure to cause the floating sleeve piston to move down relative to the tubular actuating member until stopped by an outer housing abutment resulting in a substantial upwardly directed force being exerted on the upper portion of the tubular actuating assemblage to hold the metallic sealing surfaces in firm engagement.

Further advantages of the invention will be readily apparent to those skilled in the art from the following detailed description, taken in conjunction with the annexed sheets of drawings, on which is shown a preferred embodiment of the invention.

BRIEF DESCRIPTION OF DRAWINGS

FIGS. 3A, 3B, 3C, 3D, 3E, 3F, 3G and 2H are views respectively corresponding to FIGS. 2A–2H, but showing the position of the elements of the tool subsequent to the setting of the packer in the well and the increase in the pressure of annulus fluids above the packer to effect the opening of the ball valve.

DESCRIPTION OF PREFERRED EMBODIMENTS

Figure 1:
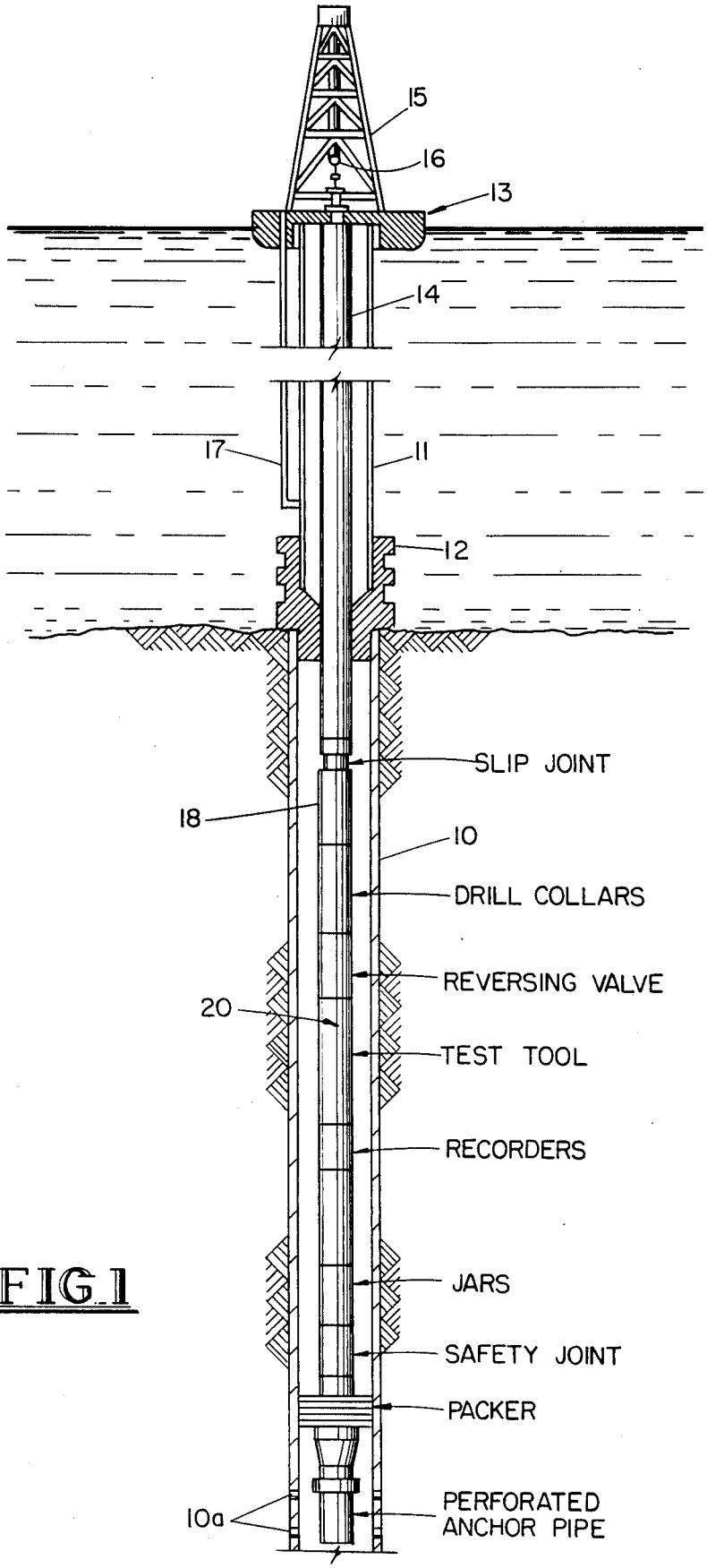
FIG. 1 is a schematic, vertical sectional view of a typical offshore well installation incorporating a test tool constructed in accordance with the subject invention.
Figure 2A:
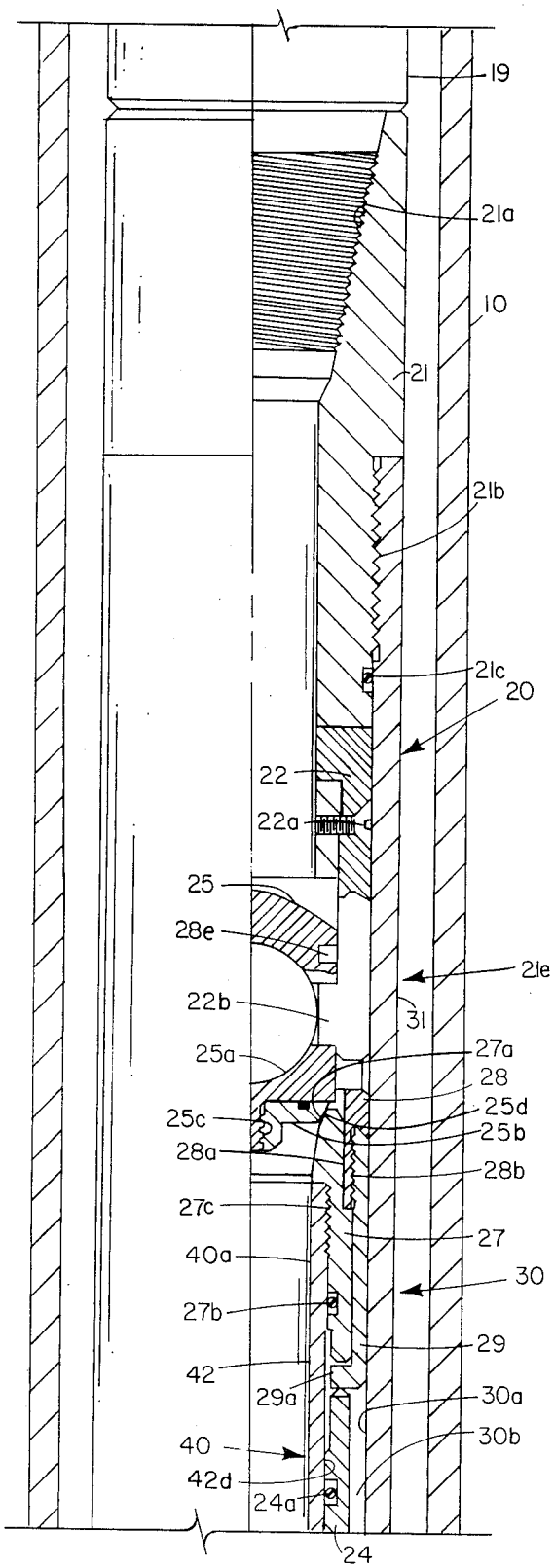
FIGS. 2A, 2B, 2C, 2D, 2E, 2F, 2G and 2H collectively represent a vertical quarter sectional view of a test tool embodying this invention, with the elements of the tool shown in their positions occupied immediately after run-in of the tool, with the ball valve in its normally closed position.

Referring to FIG. 1, a formation test tool is shown in assembled relationship in an offshore well. The well is usually cased as indicated by the numeral 10. A riser 11 normally extends from a subsea blow-out preventer stack (not shown) on a well head assembly 12 upward to a floating drill rig or platform 13 which is anchored or otherwise moored on location and is used to mount the pumps, the hoist and other mechanisms normally employed in well testing. A test string 14 extends from the platform 13 downwardly into the well. Conventional derrick structure 15 on platform 13 provides a mounting for conventional hoisting means 16 by which the test string 14 can be inserted in and removed from the well casing 10. A supply conduit 17 is provided to transmit pressured fluid, such as drilling mud, to the annulus 18 defined between the test string 14 and the casing 10 at a point in the blowout preventers (not shown) which are conventionally incorporated on the well head 12. A pump (not shown) mounted on platform 13 is provided to impart pressure to the fluid supplied through conduit 17. Also included in the formation test string are a plurality of series connected conventional components such as slip joints, drill collars, a reversing valve, a pressure operated test tool 20 incorporating this invention, pressure recorders, a jar mechanism, a safety joint, a retrievable packer, and a perforated anchor pipe. Perforated anchor pipe is disposed adjacent perforations 10*a* in casing 10 which communicate with a formation being tested. All of such elements except the pressure operated test tool are conventional and are commonly employed in test strings. The packer may be of either the mechanically actuated or pressure operated type and is shown in its set position.

Referring now to FIGS. 2A–2H, there is schematically shown a test tool 20 embodying this invention. Test tool 20 is provided at its upper end with a connecting sub 21 having internal threads 21*a* for securement to the tool string 14 below the reversing valve 19. Connecting sub 21 is additionally provided with external threads 21*b* for securement to the upper end of a tubular outer housing assemble, 30. This threaded connection is sealed by an O-ring 21*c*.

Figure 3A:
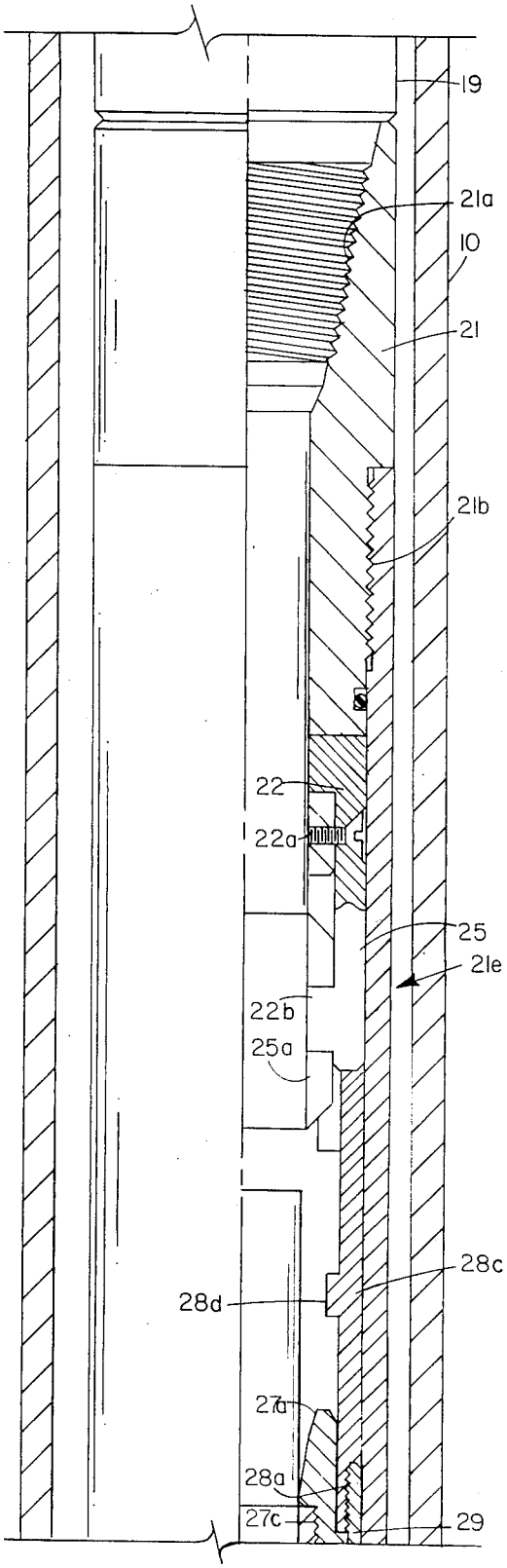
Figure 3B:
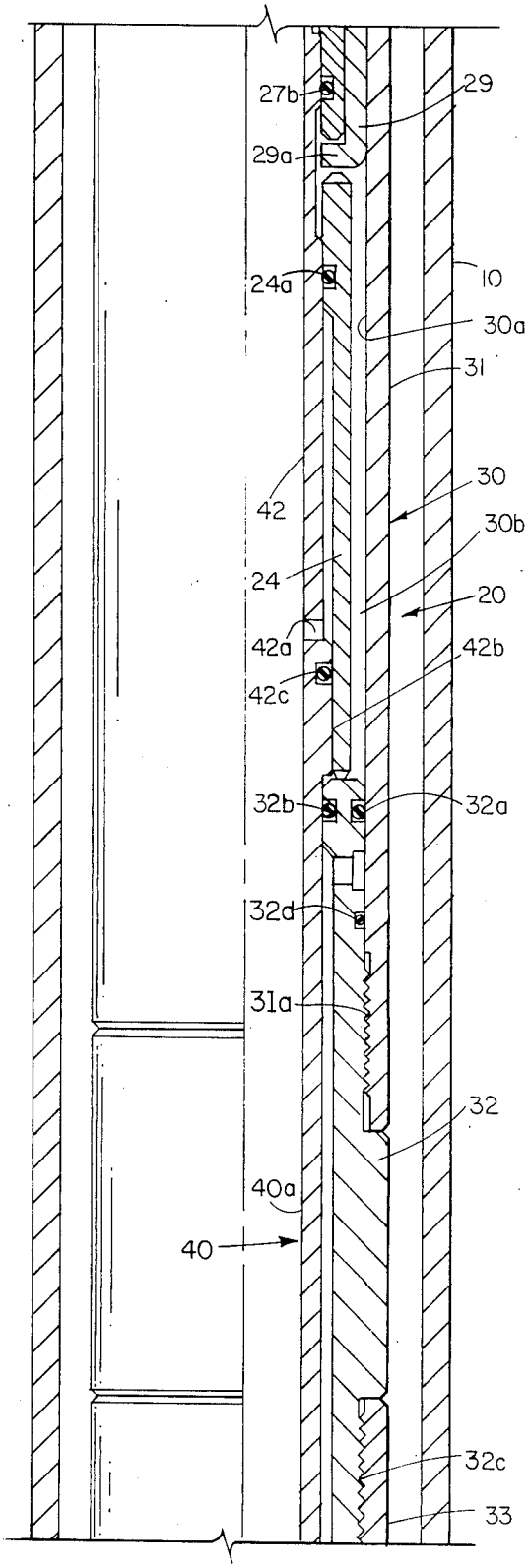
Figure 3C:
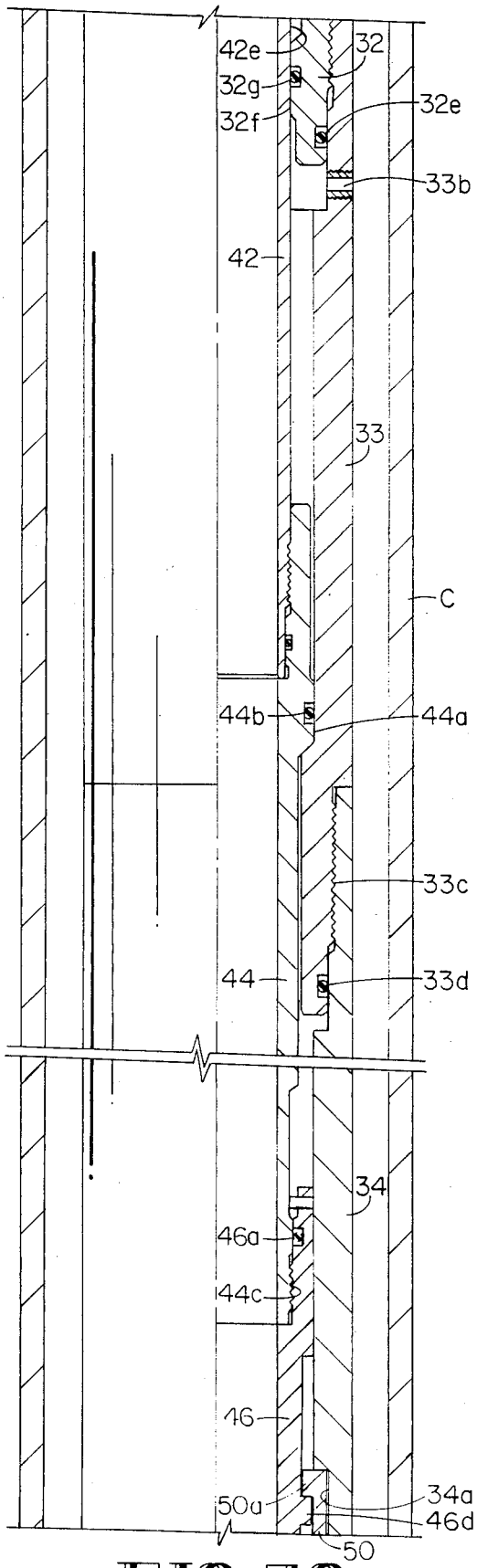
Figure 3D:
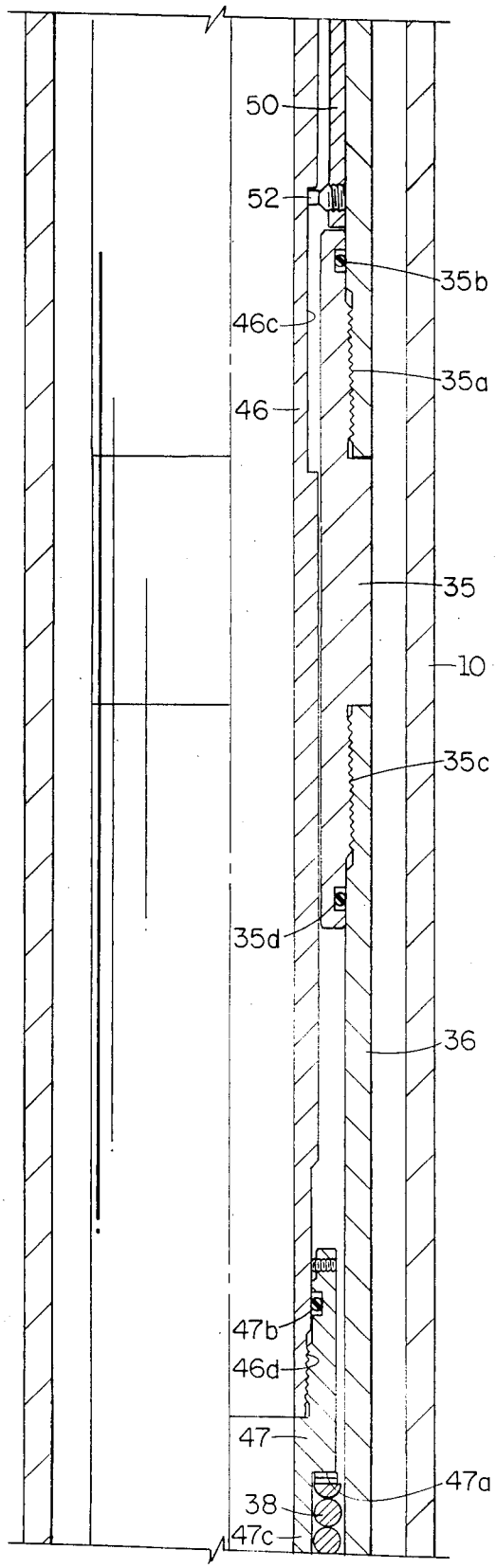
Figure 3E:
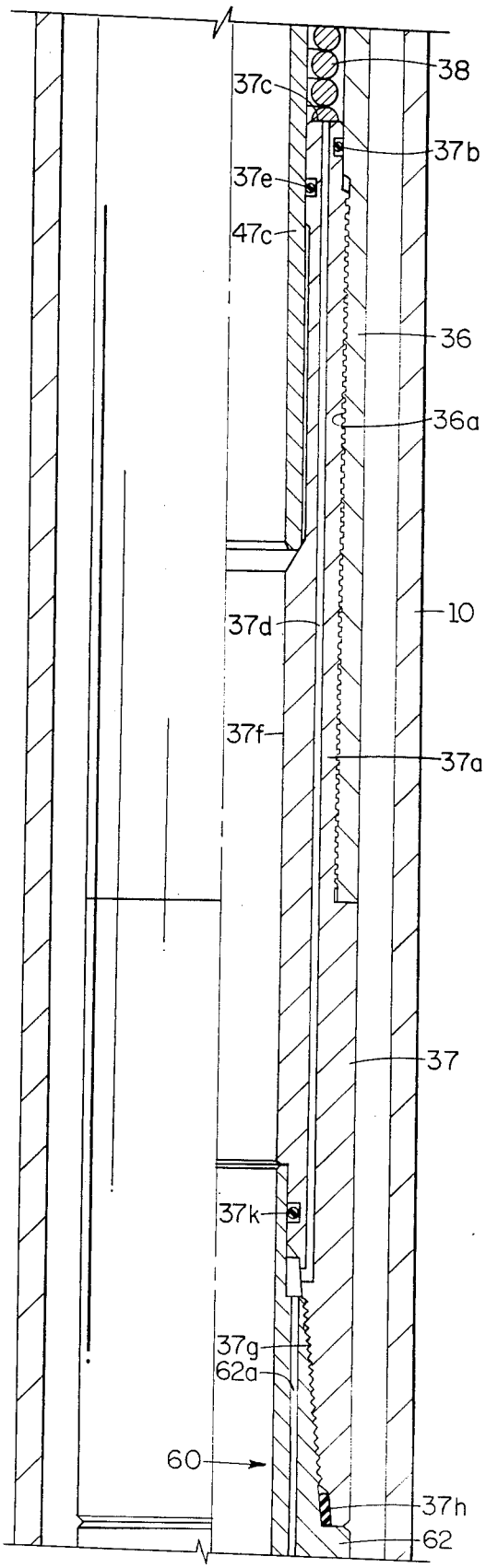
Figure 6A:
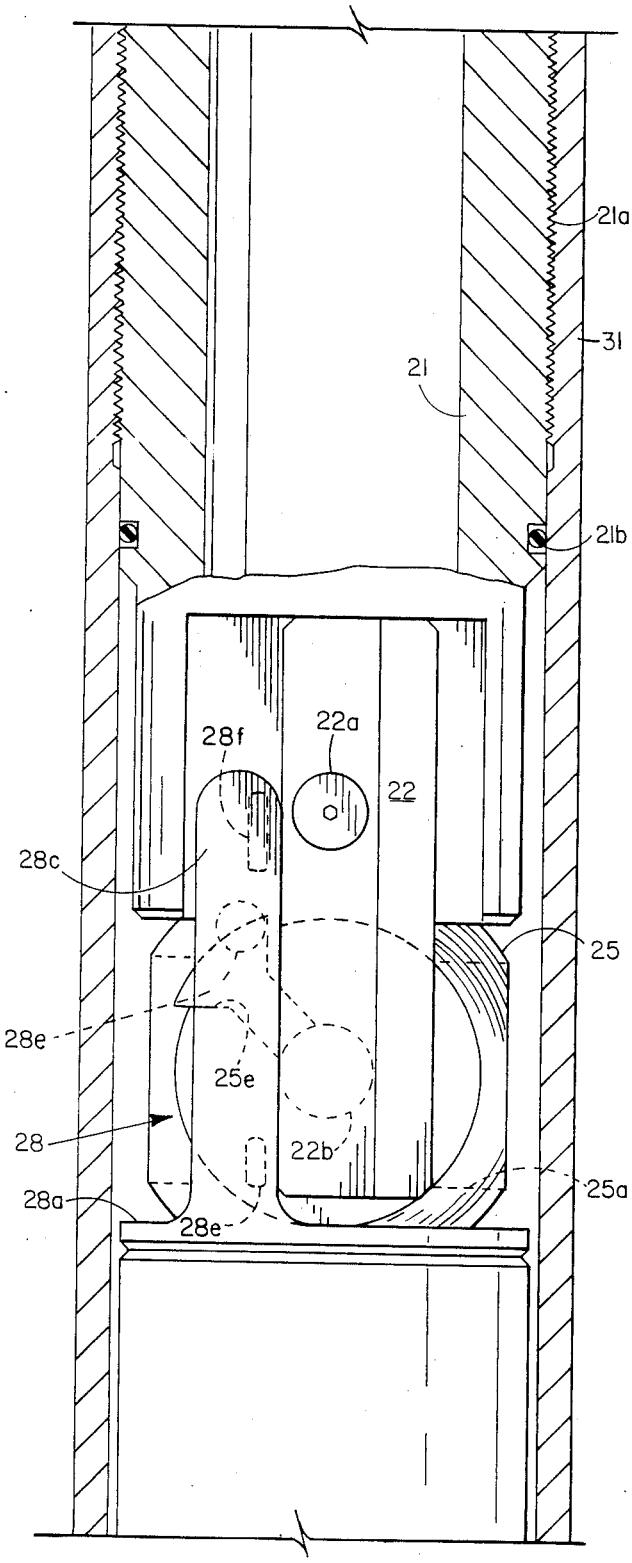
FIG. 6A is an enlarged scale sectional view of the ball valve and its cooperating elements employed in the tool embodying this invention showing the ball valve in its normally closed position.
Figure 6B:
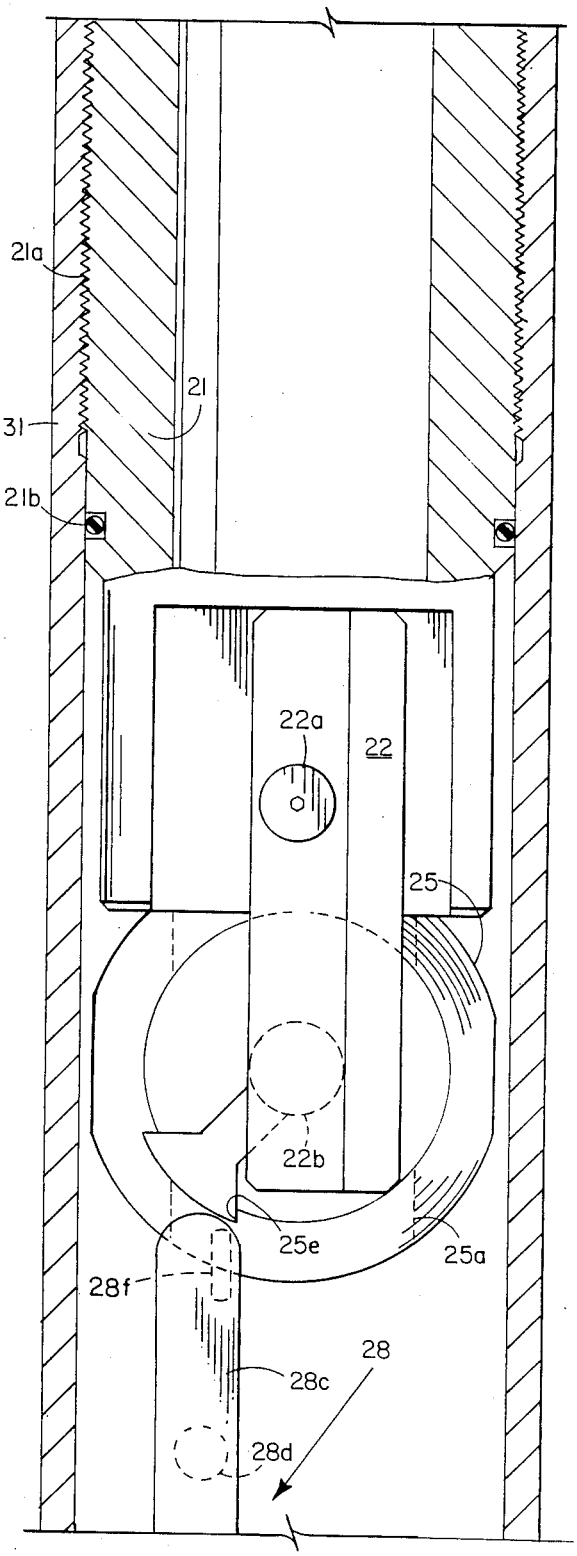
FIG. 6B is a view similar to FIG. 6A but showing the ball valve in its open position.

As best shown in FIGS. 6A and 6B, the bottom end of connecting sub 21 mounts a pair of depending ball support posts 22 which are secured in opposed, parallel relationship by suitable fasteners 22*a*. The bottom ends of the support posts 22 in turn mount a pair of internally projecting ball support pins 22*b* and a hollow ball valve 25 is mounted on such pins for pivoting between a closed position shown in FIG. 6A to a 90° displaced position shown in FIG. 6B. In the closed position, the bore 25*a* of the hollow ball 25 is disposed in transverse relationship to the bore of the housing 30 (FIG. 2A), while in the open position, the bore 25*a* is disposed in aligned relationship with the bore of housing 30 (FIG. 3A).

In the closed position of ball 25, an integral threaded projection 25*c* is disposed in depending relation. An annular metal seal element 25*b* is sealably secured to projection 25*c* and defines on its periphery, a downwardly facing, inclined annular metal sealing surface 25*d*.

A cooperating annular metal sealing surface 27*a* is formed on the top of a primary seal sleeve 27. Primary seal element 27 is provided with internal threads 27*c* by which it is secured to the top end of an upper sleeve portion 42 forming the top part of an elongated tubular actuating assemblage 40 which will be subsequently described in detail. The threaded joint 27*c* is sealed by O-ring 27*b*.

A ball camming element 28 has an annular portion 28*a* snugly surrounding the top end of the primary seal element 27. The ball camming element 28 is secured in this position by a clamping ring 29 which is threadably secured to the annular portion 28*a* by threads 28*b*, and has an inwardly projecting flange 29*a* engaging the bottom end of the primary seal element 27. A pair of diametrically opposed, upstanding arms 28*c* (FIG. 6A) are formed on the ring portion 28*a* and each arm 28*c* mounts an internally projecting cam pin 28*d*. Each cam pin 28*d* engages a cam slot 25*e* formed on the periphery of the hollow ball valve 25 (FIG. 6A). It should be specifically noted that the outer ends of cam slots 25*e* are open, thus permitting the actuating pins 28*d* to pass out of the cam slots both in an upward and a downward direction of motion of the camming element 28 relative to the ball valve 25. Additionally, a pair of axially spaced keys 28*e* and 28*f* are provided on the interior of each arm 28*c*. These keys respectively cooperate with slots not shown in ball 25 to secure ball 25 in either its fully open or fully closed position. When ball 25 is in its open position, the bore 40*a* of tubular actuating assemblage 40 (FIGS. 2A and 2B) constitutes a fluid passage serially connected to the bore of tubing string 14.

From the foregoing description, it will be readily apparent that the tubular actuating assemblage 40 can, by upward motion, move the ball valve 25 to its closed position and then continue onward past such closed position to bring the annular metal sealing surface 27*a* into snug sealing engagement with the annular metal ball sealing surface 25*d*. Conversely, on the down stroke of the tubular actuating assemblage 40, the annular sealing surface 27*a* will be moved out of engagement with the sealing surface 25*d* on the ball valve 25 before the camming pins 28*d* enter the cam slots 25*e* to initiate the rotation of the ball valve 25 from its closed to its open position. It is thereby assured that there is no pressure differential existing above and below the ball valve 25 when rotational movement of such ball valve is initiated.

The external surface of the upper portion 42 of the tubular actuator assemblage 40 cooperates with the internal surface 30*a* of the tubular housing assembly 30 to define an annular fluid pressure chamber 30*b*. Such chamber is not sealed at its top end and is in communication with the fluid pressure existing above the ball valve 25 when the ball valve 25 is in its closed position. One or more radial ports 42*a* (FIG. 2B) are provided in the wall of the upper portion 42 of the tubular actuating assemblage 40 to provide communication between the chamber 30*b* and the fluid pressure existing below the ball valve 25. A floating sleeve piston 24 is mounted in the annular fluid pressure chamber 30*b* in such fashion as to separate the fluid pressures derived from above the ball valve 25 from the fluid pressures existing below the ball valve 25. Thus, the floating sleeve piston 24 has an O-ring 24*a* mounted on its internal surface cooperating with the cylindrical exterior 42*d* of the upper portion 42 of the tubular actuating assemblage 40. Such upper portion 42 is also provided with an external annular rib 42*b* below port 42*a* within which is mounted an O-ring 42*c* and this O-ring sealingly cooperates with the lower internal surface of the floating sleeve piston 24.

The lower end of the upper part 31 of the tubular housing assembly 30 is secured by threads 31*a* (FIG. 2B) to connecting sub 32 and the threaded connection is sealed by O-ring 32*d*. The top end of connecting sub 32 mounts external and internal O-rings 32*a* and 32*b* which sealably cooperate with the internal and external surface of the annular chamber 30*b*. Thus the lower end of annular fluid pressure chamber 30*b* is completely sealed.

It will also be apparent that whenever the fluid pressure below the closed ball valve is in excess of the fluid pressure above the closed ball valve, the floating sleeve piston 24 will be urged upward into an opposing mechanical engagement with the retainer ring 29, thus cancelling any force due to the floating sleeve piston. On the other hand, when the fluid pressure above the ball valve is greater than the fluid pressure below the ball valve, the floating piston 24 will be urged downward into engagement with the top of outer housing sub 32 so that an upward pressure force results between abutment 32 and the seal sleeve 27 to more firmly secure it in sealing engagement with the sealing surface 25*b* on the ball valve 25. In other words, the total area of downwardly facing surfaces exposed to the fluid pressure above the ball valve will exceed the upwardly facing surfaces exposed to said fluid pressure.

Proceeding downwardly from the connecting sub 32, (FIGS. 2B and 2C) it will be noted that external threads 32*c* on the bottom end of connector sub 32 provide a connection with an intermediate part 33 of the outer tubular housing 30. This connection is sealed by an O-ring 32*e*. A threaded radial port 33*b* is provided in the upper end of the intermediate part 33 to permit annulus fluid pressure to enter the bore of tubular housing 30. Immediately below the radial port 33*b*, the upper portion 42 of the tubular actuating assemblage 40 is secured by threads 42*c* to a piston sleeve 44. Piston sleeve 44 has a radially enlarged shoulder portion 44*a* mounting an O-ring 44*b* in sealing engagement with the bore 33*a* of intermediate part 33 of outer housing 30. An annular internal shoulder 32*f* on connecting sub 32 mounts O-ring 32*g* which sealingly engages the external surface 42*e* on upper portion 42 of actuating assemblage 40. Thus, fluid pressure from the annulus exerts a downward, or valve opening force on the actuating assemblage 40.

The bottom end of intermediate housing part 33 is provided with external thread 33*c* for securement to a lock mounting sleeve 34. Threads 33*c* are sealed by O-ring 33*d*. Lock mounting sleeve 34 is provided at its bottom with counterbore 34*a* which rotatably mounts a locking sleeve 50. Locking sleeve 50 is retained in the counterbore 34*a* by the top end of a continuation sleeve 35 (FIG. 2D) which is secured to lock mounting sleeve 34 by external threads 35*a* and the threads are sealed by an O-ring 35*b*. Locking sleeve 50 is provided with a plurality of internally projecting, peripherally spaced lugs 50*a*.

The lower end of piston sleeve 44 of the tubular actuating assemblage 40 is provided with external threads 44*c* which threadably engage a tubular lock carrying sleeve 46. The threads 44*c* are sealed by an O-ring 46*a*. A plurality of peripherally spaced external locking lugs 46*b* are formed on the exterior of locking sleeve 46 and cooperate with the internally projecting locking lugs 50*a* to effect the locking of the tubular actuating assemblage 40 in a valve open position. Thus, the internally projecting, peripherally spaced locking lugs 46*b* may pass between the internal lugs 50*a* or may be angularly aligned so that the lugs 46*b* and 50*a* are in abutment, particularly on the upward stroke of the tubular actuating assemblage 40.

The rotational alignment or indexing of the locking sleeve 50 is effected by the relative axial movement of the tubular actuating assemblage 40 with respect to the locking sleeve 50. A closed end J-slot 46*c* is formed on the periphery of inner locking sleeve 46 and has the configuration illustrated in FIG. 4. A radial pin 52 is secured in the lower portions of the locking sleeve 50 and cooperates with the J-slot 46*c*.

Figure 4:
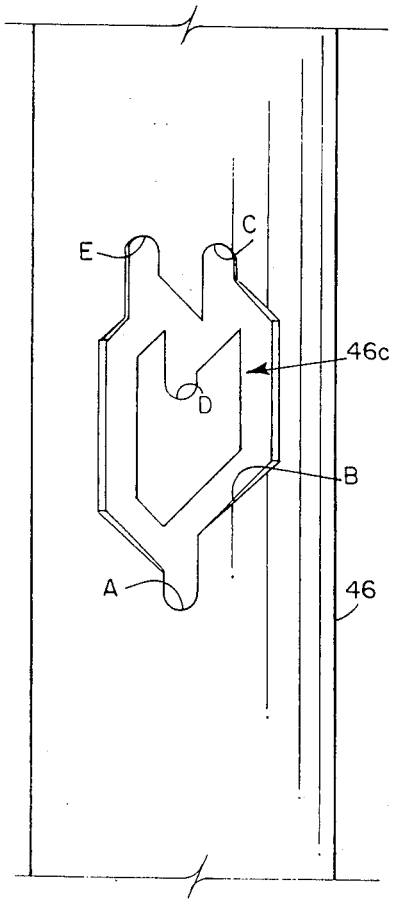
FIG. 4 is an elevational view of the cam slot employed in the lock setting mechanism of the tool embodying this invention.

When the tubular actuating assemblage 40 is in its uppermost position, corresponding to the closed position of the ball valve 25, the pin 52 will be in position A of the J-slot 46*c* (FIG. 4). As the tubular actuating assemblage 40 moves downwardly to effect the opening of the ball valve 25, the pin 52 moves into the axially inclined portion B of the J-slot 46*c* which positions the external locking lugs 46*b* to pass between the internal locking lugs 50*a*. Hence, the tubular actuating assemblage 40 may be moved downwardly from the valve closed to the valve opening position and then continued downwardly to locate the pin 52 in position C in the J-slot 46*c*. This position hereinafter will be referred to as the lock setting position, and it will be noted that the passage of the pin 52 from a position A to position C effects an angular indexing of the locking sleeve 50 so that, upon return upward movement of the tubular actuating assemblage 40 in the valve closing direction, the internal locking lugs 50*a* of the locking sleeve 50 will be further angularly shifted to lie in the path of the external locking lugs 46*b* on the tubular actuating assemblage 40 and the actuating assemblage 40 will be locked in a position corresponding to the full open position of the ball valve 25. In this valve open-locked position, the pin 52 will be in position D in J-slot 46*c*.

To effect the return of the tubular actuating assemblage 40 to its valve closed position, it is necessary to again increase the pressure of the annulus fluid above the packer to shift the tubular valve actuator assemblage 40 downwardly to the lock setting position, and the pin 52 will then move in the J-slot from position D to position E and effect an angular index of the locking sleeve 50 in so doing. This position of the actuating assemblage 40 will be referred to as the valve open-fail safe position. While shown as being at the same axial position as the lock setting position, a change in the configuration of the J-slot 46*c* will permit the lock setting and valve open-fail safe positions to be at different axial spacings below the full open position of actuating assemblage 40, if desired.

A subsequent decrease in the pressure of the annulus fluids will permit the tubular actuating assemblage 40 to move upwardly to its valve closed position and the pin 52 to move from position E in the J-slot 46*c* to position A, completing the angular indexing of the locking sleeve 50 so that the external locking lugs 46*b* on the tubular actuating member 40 now pass between the internal locking lugs 50*a* on the locking sleve 50, thus permitting the tubular actuating assemblage 40 to return to its valve closed position.

The advantages of this arrangement for effecting the automatic locking of the ball valve 25 in its open position will be pointed out in the subsequent operation section of the disclosure.

As stated, the lower end of the outer lock mounting sleeve 34 is threadably connected to the top end of a connecting sub 35. The lower end of connecting sub 35 is provided with external threads 35c which are connected to a spring housing sleeve 36. These threads are sealed by an O-ring 35d.

The lower end of spring housing sleeve 36 is provided with internal threads 36a which are secured to an upwardly projecting portion 37a of a pressure transmitting sub 37 (FIG. 2E) and sealed by an O-ring 37b. The sub 37 is provided with at least one axially extending, small diameter bore 37d in its tubular wall which extends entirely through the sub. The top end 37c of the sub 37 functions as a spring anchor for supporting the bottom end of compression spring 38.

The lock carrying sleeve 46 of the tubular actuating assemblage 40 is provided at its lower end with external threads 46d, sealed by an O-ring 47b, which are engagable with a spring guide sleeve 47 having a downwardly facing shoulder portion 47a engagable with the top end of the compression spring 38 and a reduced diameter guide portion 47c extending through the spring 38 and being slidably and sealably engaged by O-ring 37e within the top end of the sub 37 of the outer housing 30. Thus, the bias of the spring 38 acts on the tubular actuating assemblage 40 in an upward, or valve closing direction and hence maintains a substantial force on the cooperating metal sealing elements of the ball valve in its closed position. Pressure transmitting sub 37 is additionally provided in its medial portion with an internally projecting portion 37f which functions as a stop for the downward motion of the tubular actuating assemblage 40 by engaging the bottom end 47c of the lower part 47 of the tubular actuating assemblage 40.

Figure 2B:
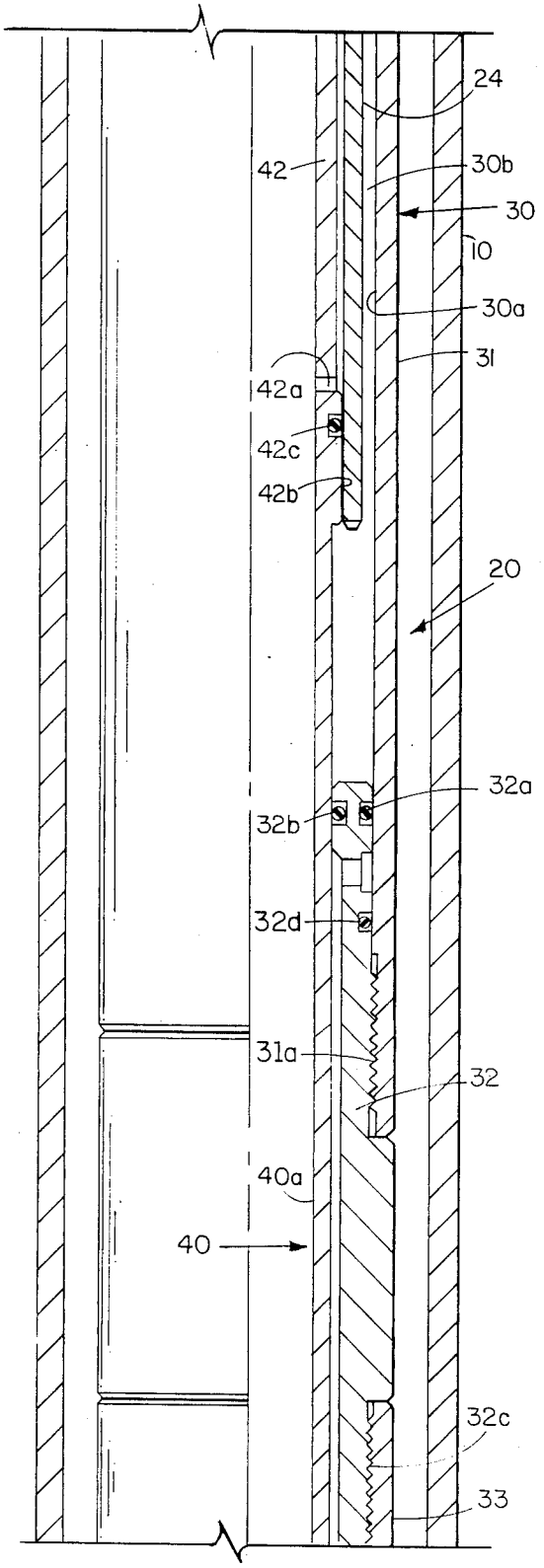
Figure 2C:
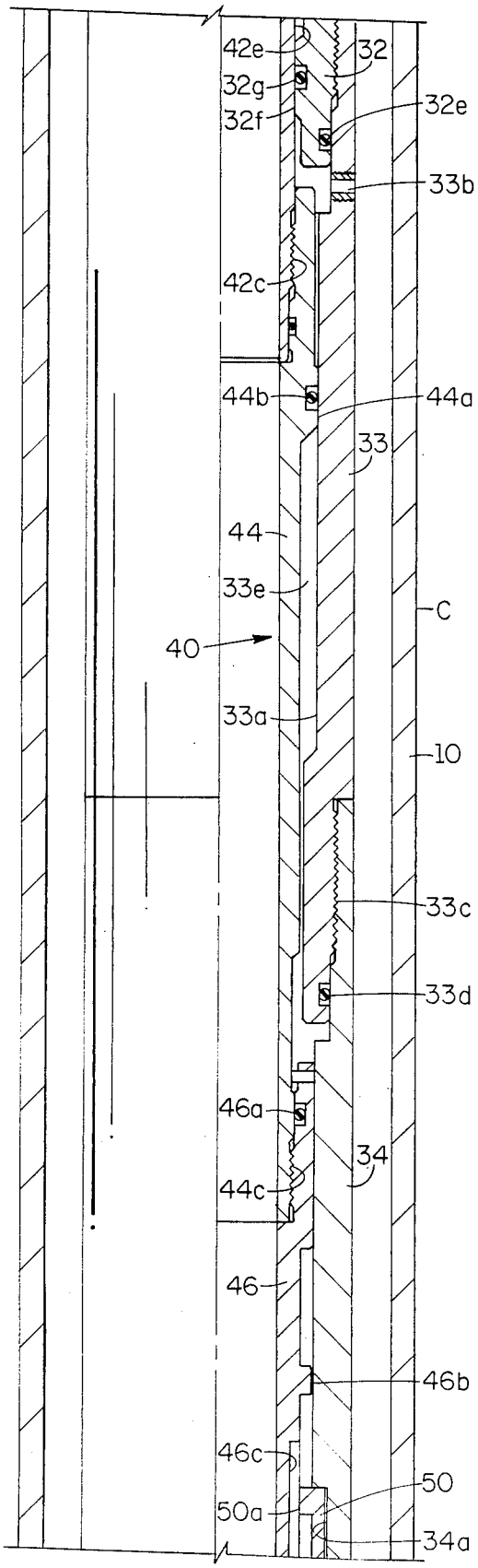
Figure 2D:
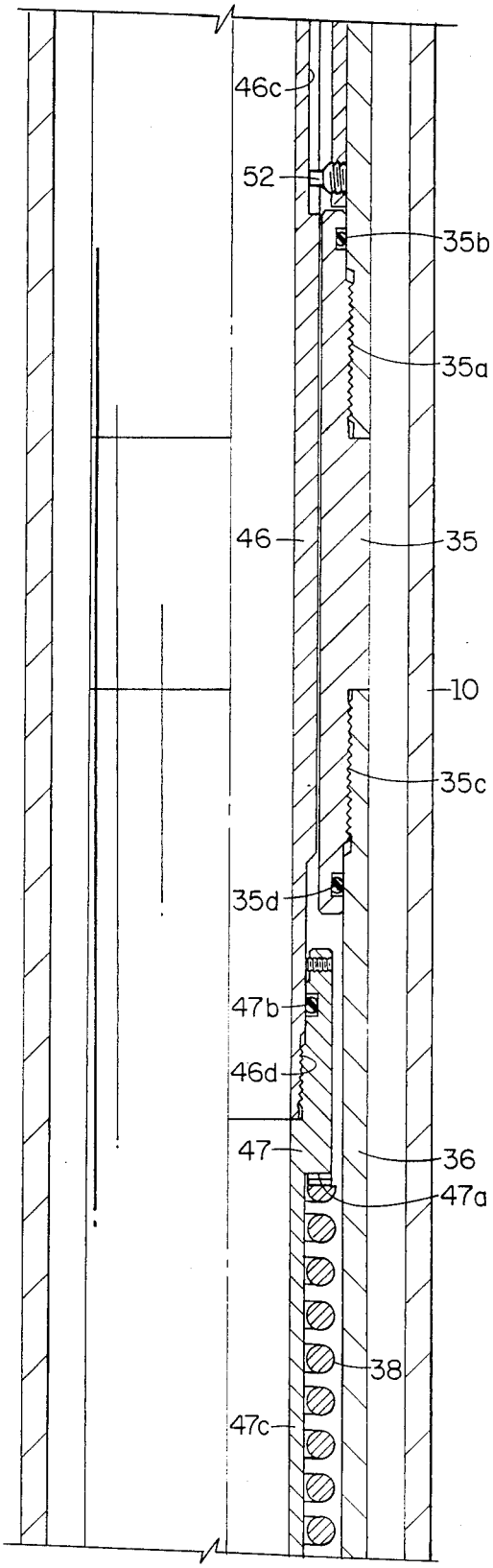
Figure 2E:
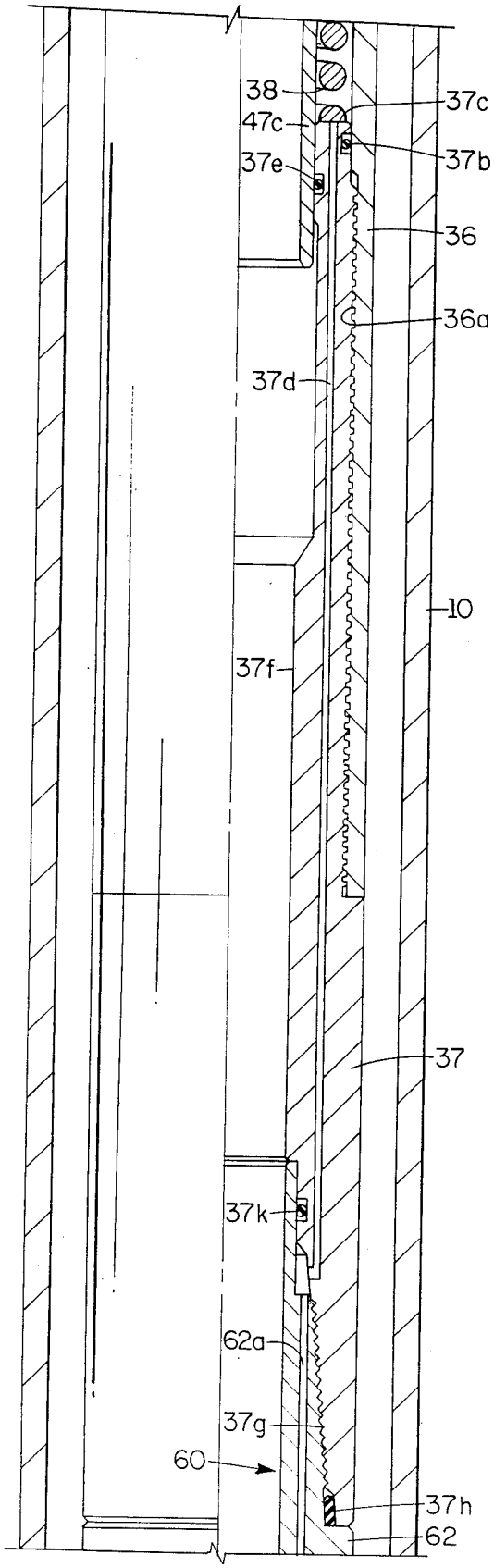
Figure 2F:
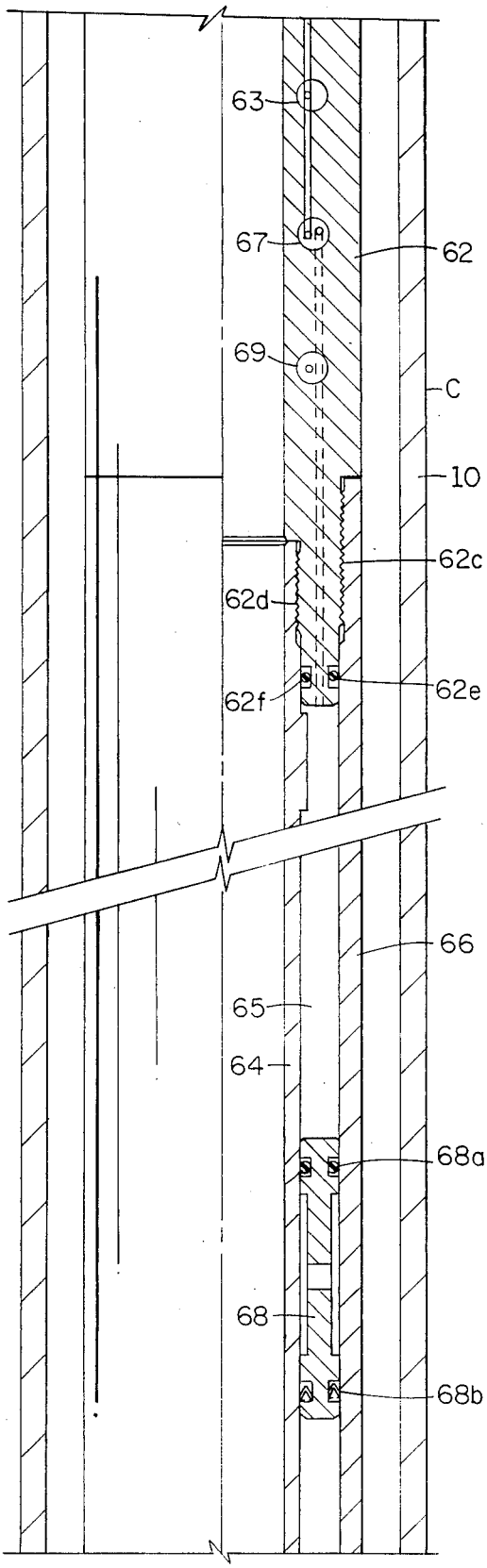
Figure 3F:
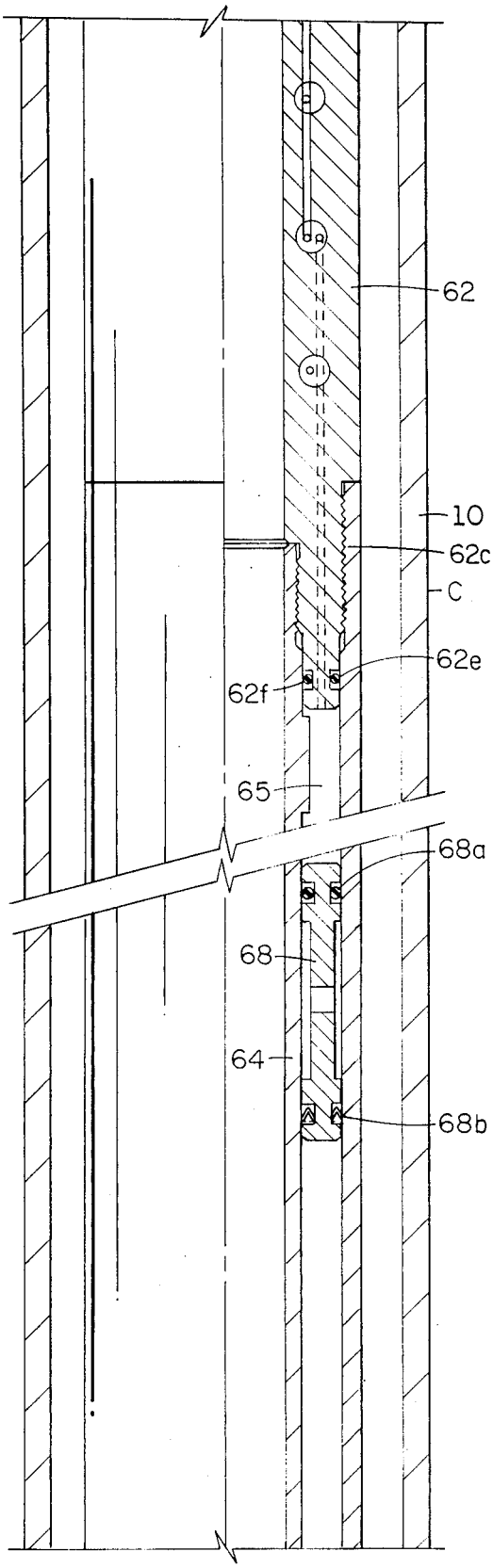
Figure 2G:
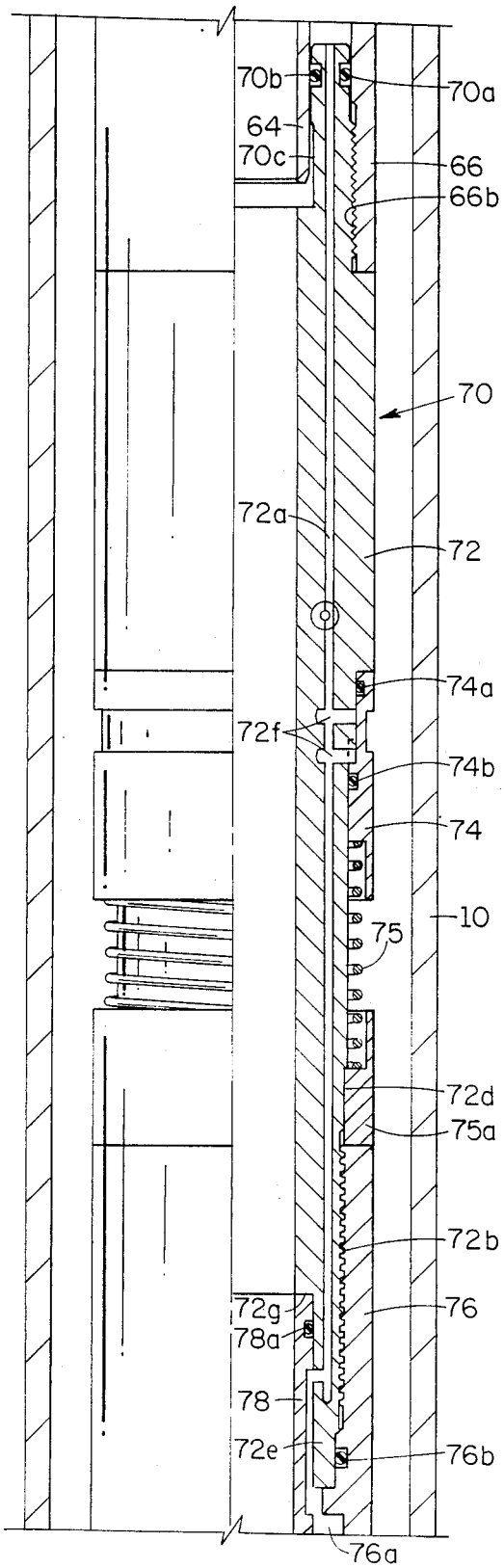
Figure 3G:
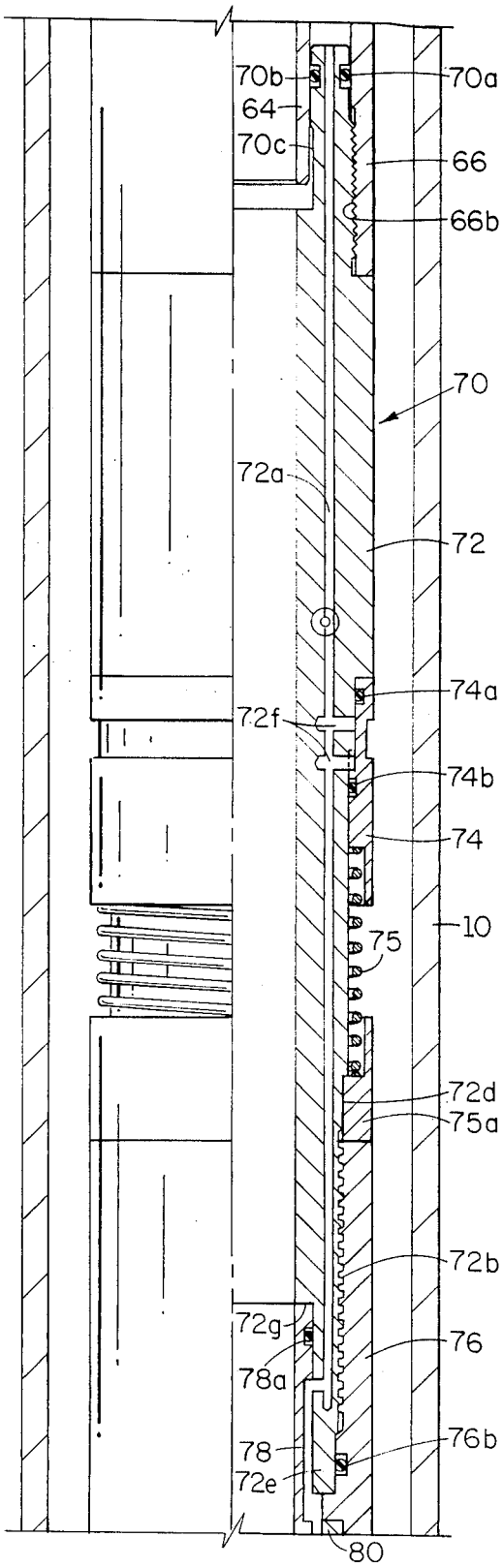

The bottom end of pressure transmitting sub 37 is provided with internal threads 37g and O-ring 37h for connection to a tubular nitrogen chamber assemblage 60. The internal threads 37g on the fluid pressure communicating sub 37 are engaged by external threads formed on the upper end of a tubular assembly 60 defining a reference pressure chamber. Tubular assembly 60 comprises an upper connecting sub 62 which is provided with external threads cooperating with the internal threads 37g and this threaded joint is sealed by O-rings 37h and 37k. An axially extending fluid pressure conduit 62a is formed in the connecting sub 62 and communicates at its top end with the axial fluid passage 37d and at its lower end projects through the bottom of the connecting sub 62 (FIG. 2G). At axially spaced intervals, the axial fluid pressure passage 62a is in fluid communication with three manually operated valves 63, 67 and 69. Valves 63, 67 and 69 comprise a conventional valving arrangement for filling the chambers above and below the axial fluid passage 62a with a compressible fluid, such as nitrogen at a pressure on the order of 2500 p.s.i.. Such filling valves are conventional, hence will not be described in detail.

The lower portion of the top sub 62 of the tubular assembly 60 is provided with external threads 62c and the internal threads 62d. The threads 62c mount an external sleeve 66, while the internal threads 62d mount an internal sleeve 64 in spaced, concentric relationship to the external sleeve 66. The threaded connections are sealed by O-rings 62e and 62f respectively. An annular fluid pressure chamber 65 is thereby defined between the spaced concentric sleeves 64 and 66. Chamber 65, together with the axial passage 62a, the axial passage 37d and the annular fluid pressure chamber 33e below piston shoulder 44a are filled at the surface with the nitrogen gas through the aforementioned valves 63, 67 and 69.

The lower end of the annular fluid pressure chamber 65 is sealed by a floating piston 68 having an upper O-ring seal 68a and a lower wiper seal 68b cooperating with the spaced walls of the external sleeve 66 and the internal sleeve 64. Thus, the piston shoulder 44a is subjected to an upward bias by the trapped pressurized nitrogen gas contained in fluid pressure chamber 33 and supplied to such chamber through the aforementioned axial passages from 62a and 37d from the top of annular fluid pressure chamber 65.

The outer sleeve 66 of the tubular assembly 60 is provided at its lower end with internal threads 66b to which is secured a relief valve assembly 70. Assembly 70 has an upper relief valve sub 72 having an O-ring 70a sealing threads 66b. The bottom end of inner sleeve 64 is sealed to an internal bore 70c formed on relief valve sub 72 by an O-ring 70b.

An axial passage 72a extends entirely through relief valve sub 72 to communicate with a valving chamber 76a defined in the top end of an isolation valve sub 76 which is secured to external threads 72b on the bottom end of sub 72 and such threads are sealed by O-rings 76b.

The lower end 72d of sub 72 is of reduced diameter and cooperates with a recessed upper end portion 75a of isolation valve sub 76 to define an annular spring and valve support. A pair of radial ports 72f communicate between the well annulus and the axial fluid passage 72a. Radial ports 72f are normally closed by an annular relief valve 74 having seals 74a and 74b straddling radial port 72f at different diameters on sub 72, thus imparting a downward bias on relief valve 74 by the initial trapped nitrogen in chamber 33e. Valve 74 is held in its upper closed position by a spring 75 mounted between a downward face 74c on valve 74 and an annular spring guide 75a which rests on the top of isolation valve sub 76.

The closing spring force exerted by spring 75 on valve 74 is selected to maintain valve 74 closed at a level of 700 to 1000 p.s.i. in the trapped nitrogen above the external pressure in the well. Of course, the valve 74 is also urged to closed position by the annulus hydrostatic pressure, but, as will be described, the fluid pressure in axial passage 72a is increased to a level above such annulus hydrostatic pressure to close valve 25.

As previously mentioned, the axial passage 72a, which communicates with the bottom end of floating piston 68 in the nitrogen trapping chamber 65, communicates at its lower end with a piston valve chamber 76a. Chamber 76a is defined between the bore 76e of sub 76 and the exterior of an inner sleeve 78. Sleeve 78 is trapped between a downwardly facing shoulder 72g of sub 72 and an upwardly facing shoulder 90a (FIG. 2H) of a bottom sub 90. Seal 78a seals against the bottom bore of the sub 72 and seals 90b seals the bottom end of sleeve 78. A radial port 76f in the lower end of chamber 76a communicates with the well annulus, as does a lower port 76g.

An isolation piston valve 80 is slidably and sealably mounted in piston chamber 76a. The upper end of isolation valve piston 80 mounts an external O-ring 80a engaging the bore 76e of sub 76. An inner O-ring 80b on valve piston 80 engages the external periphery of inner sleeve 78. An enlarged external shoulder 78c mounts an O-ring 78d which engages the inner bore of valve piston 80. A radial port 78b connects the tubing bore to the chamber 78e defined between seals 78d and 80d.

Thus any increase in annulus pressure over the tubing pressure, hence above hydrostatic pressure, will result in a net upward force on isolation valve piston 80, due to the fact the annular seal area defined by the seals 80*a* and 80*b* is greater than the seal area defined by seals 80*a* and 78*d*.

Figure 2H:
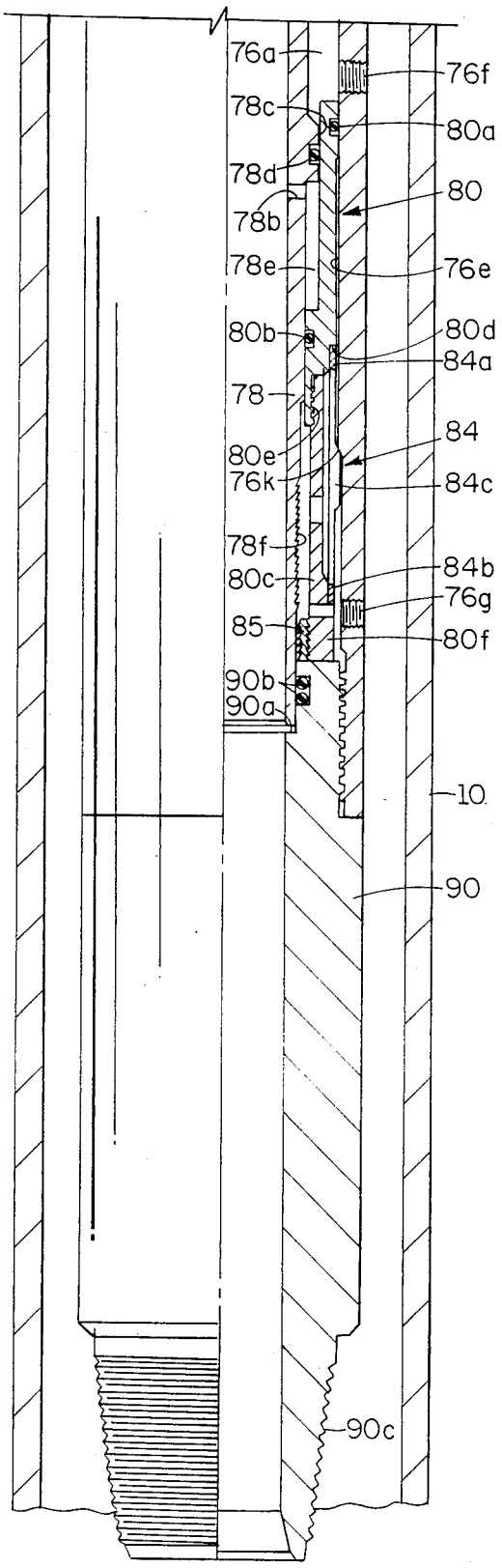
Figure 3H:
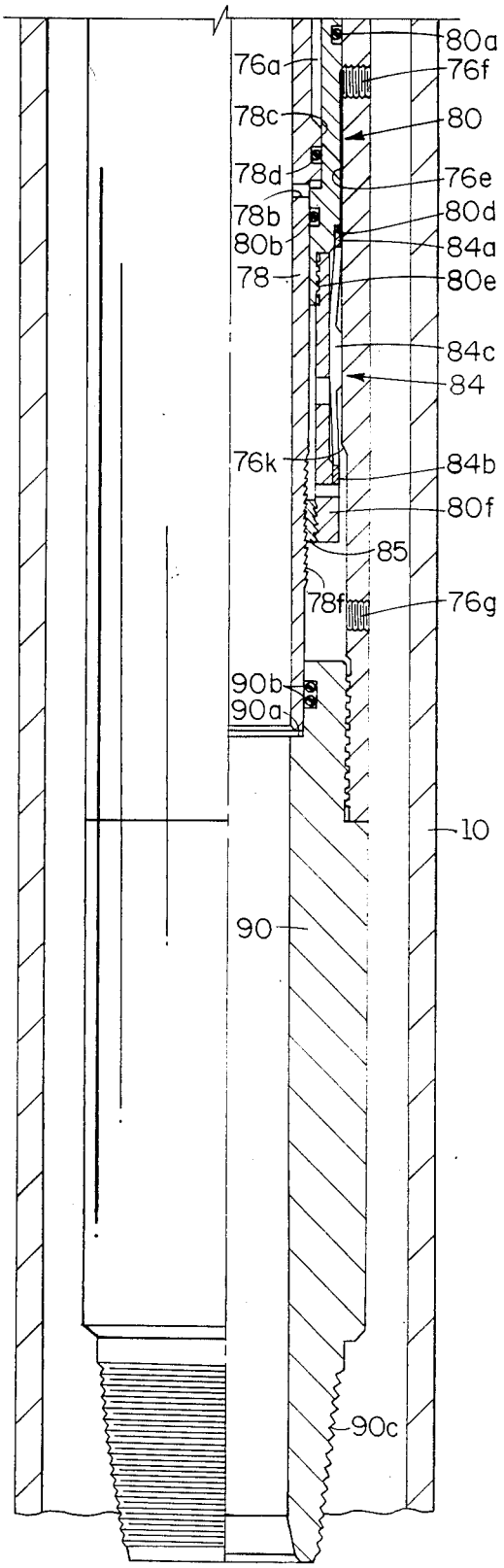
Figure 5:
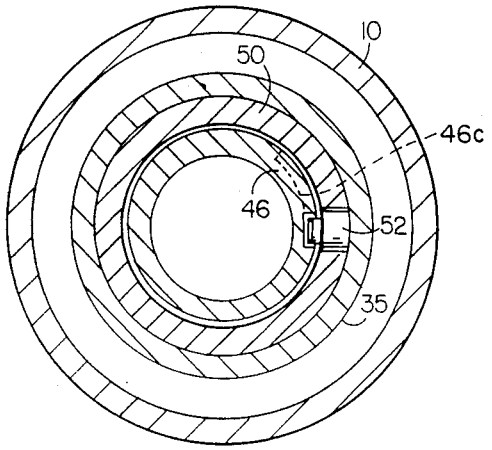
FIG. 5 is a sectional view taken on the plane 5—5 of FIG. 2E.

The isolation valve piston 80 is secured in its run-in position shown in FIG. 2H by a collet 84 having ring portions 84*a* and 84*b* at each end which are trapped between a downwardly facing surface 80*d* on piston 80 and a piston extension 80*c* secured to threads 80*e* on valve piston 80. Collet 84 has enlarged, peripherally spaced head portions 84*c* engaging a downwardly facing inclined shoulder 76*k* formed on sub 76. The angle of engagement between collet heads 84*c* and inclined shoulder 76*k* is proportioned to require an increase in annulus pressure over hydrostatic pressure on the order of 700 to 1000 p.s.i. to effect sufficient upward movement of isolation valve piston 80 to close off upper port 76*f* by seal 80*a*. Closure of upper port 76*f* traps a fluid pressure in nitrogen chamber 65 equal to 700 to 1000 p.s.i. above the annulus hydrostatic pressure, thus providing a substantial additional force on mandrel assemblage 40 biasing it to its valve closing position.

Downward movement of isolation valve piston 80 is prevented by a conventional body lock ring assemblage 85 operating between the lower end 80*f* of valve piston extension 80*c* and wicker threads 78*f* provided on the lower end of inner sleeve Bottom sub 90 is provided with threads 90*c* for connection to the remainder of the tool string schematically shown in FIG. 1.

OPERATION

The entire testing tool string schematically illustrated in FIG. 1 is progressively assembled on the drilling platform 13 and lowered into the riser 11 as the assembly proceeds. When the test tool 20 embodying this invention is assembled in the tool string, compressed nitrogen gas will be supplied through the operation of the filling valves 63, 67 and 69 to fill the interconnected annular fluid pressure chambers 65 and 33*e* with such gas at a modest pressure, normally about 2500 p.s.i. Such pressure will act on the lower face of piston shoulder 44*a* to bias the actuating assemblage 40 to its upper most position showin in FIG. 2D, and will concurrently urge the floating piston 68 downwardly to a position near the bottom of fluid pressure chamber 65, as shown in FIG. 2F.

When the assembly of the entire test tool string is completed, the string is then lowered into the well and the internal bore of the test tool string is subjected to the hydrostatic pressure of the fluids contained in the well which, of course, increases as the lowering of the tool progresses. The well fluids enter the bottom of the annular fluid pressure chamber 65 through the isolation valve 80 which is in its open position shown in FIG. 2H. Floating piston 68 of course separates the well fluids from the nitrogen contained in the chamber 65 above the floating piston 68.

When the hydrostatic pressure of the well fluids entering the bottom of the chamber 65 exceeds the pressure of the compressed nitrogen gas, the floating piston 68 will move upwardly in the chamber 65, thus transmitting the hydrostatic well fluid pressure to the trapped nitrogen gas contained in chamber 65 above the floating piston 68 and in the interconnected chamber 33*e* below piston shoulder 44*a*.

When the perforated anchor pipe secured to the bottom of the testing tool string reaches a position adjacent the formation to be tested, as indicated by the perforations 10*a* in FIG. 1, the packer is then set or seal landed in conventional fashion. The well fluid in the annulus surrounding the test tool string above the packer is then isolated from the well fluids adjacent the formation and communicates with the isolation chamber 76*a* through the open radial ports 76*f* and 76*g*. The pressure of the trapped nitrogen gas will then be exactly equal to the hydrostatic pressure of the well fluids. The mud pumps (not shown) on the platform 13 are then energized to increase the fluid pressure in the well annulus above the set packer by pumping through the conduit 17 to a level of 700 to 1000 p.s.i. above the hydrostatic pressure. The first effect of such increased annulus pressure above the hydrostatic level is to cause an upward shifting of the isolation valve piston 80 to its closed position (FIG. 2H). Thus, the well fluids present in the bottom portion of the fluid pressure chamber 65 are trapped at a reference pressure approximating 700 to 1000 p.s.i. above the hydrostatic pressure of the well fluids. Since the piston area of shoulder 44*a* is, in a typical installation, on the order of 5 square inches, the resultant additional compressive force on the metal-to-metal seals is very substantial.

A further increase in the pressure of the annulus fluids above the packer produces a downward displacement of the actuating assemblage 40 by fluid entering port 33*b* and engaging the upper face of piston shoulder 44*a*. Such downward movement of the actuating assemblage 40 results in downward movement of the primary valve actuating element 27. Downward movement of element 27 opens the seal between the metal seal surface 27*a* and the metal seal surface 25*d* mounted on the closed ball valve 25, thus equalizing pressure groove and below the closed ball valve. Further downward movement of the primary actuating element 27 causes the ball camming pins 28*d* (FIG. 6) to enter the open end of the respective cam slots 25*d* provided on the periphery of the ball valve 25 and rotate the ball valve 25 from its closed position shown in FIGS. 2A and 6A to its open position shown in FIGS. 3A and 6B.

Still further downward movement of the tubular actuating assemblage 40 produced by the fluid forces on piston shoulder 44*a* will cause such actuating assemblage to move past its valve opening position and downwardly to its lock setting position wherein the external locking lugs 46*b* on the portion 46 of the tubular actuating assemblage 40 have passed between the internal locking lugs 50*a* on the locking sleeve 50. This position of the elements of the test tool is shown in FIGS. 3A–3H.

With the ball valve 25 open, formation fluids can flow upwardly through the test tool string and the flow rate and pressure can be recorded by the recording element incorporated in such string. To effect the reclosing of the ball valve 25, a cycle of pressure changes in the annulus fluid above the set packer has to be accomplished due to the fact that the tubular actuating assemblage 40 always moves through the ball opening position to the lock setting position. First, the pressure is reduced in the annulus fluid to permit the tubular actuating assemblage 40 to rise to the valve open-locked position. It will be prevented from moving beyond this position by the interengagement of the internally projecting lugs 50*a* on the locking sleeve 50 with the externally projecting lugs 46*b* provided on the lower part 46 of the tubular actuator assemblage 40. Thus, the pressure of annulus fluid must be increased to shift the tubular actuator assemblage 40 downwardly to the valve open-fail safe position, following which a decrease in the annulus fluid pressure above the packer will result in shifting locking ring 50 to permit the tubular actuator member 40 to move upwardly past the locking lugs 50*a* of the locking ring 50 and proceed from the valve open-fail safe position to the valve closed position.

The automatic locking of the tubular actuating member 40 in its valve open position is of particular advantage during certain run-in procedures and well killing procedures. With the apparatus embodying this invention, when the test tool 20 is initially assembled at the surface in the tool string, gas pressure from a cylinder or compressor may be applied to the threaded port 33*b* in the tubular housing 30 to the top surface of the piston shoulder 44*a*, thus driving the tubular actuating assemblage 40 downwardly from its valve closed position through the valve open position and to the lock setting position. When the externally applied gas pressure is removed, the tubular actuator assembly 40 will only return to the lock open position due to the abutment of the internal locking lugs 50*a* on the locking sleeve 50 with the external locking lugs 46*b* on the lower part 43 of the tubular actuating assemblage 40. The ball valve 25 is thus effectively locked in its open position and the run into the well can be accomplished more rapidly and without hydraulic lock due to landing seal assemblies, by virtue of the fact that the well fluids have an unimpaired passageway up through the bore of the entire tool string.

When the tool string reaches the test depth, fluid can be displaced and then the packer set, or seal assembly landed. The above described cycle of variations in annulus pressure can be effected to release the tubular actuator assemblage 40 from the lock sleeve 50 and permit such member to return to its valve closing position, if such is desired.

A further feature of the apparatus of this invention lies in its utility in very deep wells wherein the hydrostatic fluid pressures encountered are excessively high. In such event, the fluid pressure trapped by the operation of the isolation valve 80 will remain at such high level when the tool is withdrawn from the well. For this reason, the relief valve 74 is incorporated in the relief valve sub 72. The relief valve 74 will open whenever the fluid pressure within the lower chamber 65 substantially exceeds (i.e. 700 to 1000 p.s.i.) the annulus hydrostatic pressure. Thus, as the tool string is with drawn from the well, the annulus hydrostatic pressure is gradually reduced and the relief valve 74 opens to bleed off any excessively high pressure trapped in the chambers 65, 33*e* and the passages intercommunicating such chambers. Thus, the only trapped pressure existing in the tool when it arrives at the surface is a pressure corresponding to the relatively low pressure of the compressed nitrogen gas that was originally introduced into the tool.

The elimination of movable elastomeric seals contacting the ball valve and utilization of only a metal-to-metal seal eliminates a repeated source of failure in ball type test valves. The hydraulic mechanical linkage converting any pressure differential above the valve to an increased sealing force makes the metal-to-metal ball seals practical even in wells producing substantial quantities of gas. Lastly, the increased closing force on the metal-to-metal sealing surfaces produced by downhole charging of the nitrogen chamber to a pressure substantially exceeding the annulus pressure is an important factor in maintaining the integrity of the metal-to-metal seal of the ball valve.

Although the invention has been described in terms of specified embodiments which are set forth in detail, it should be understood that this is by illustration only and that the invention is not necessarily limited thereto, since alternative techniques will become apparent to those skilled in the art in view of the disclosure. Accordingly, modifications are contemplated which can be made without departing from the spirit of the described invention.

What is claimed and desired to be secured by Letters Patent is:

1. A fluid pressure controlled apparatus having tubular housing means adapted to be connected to a pipe string and having an axial flow passage extending therethrough from an isolated well formation;

a valve mounted in said tubular housing means and shiftable between open and closed positions relative to said axial flow passage;

internal valve actuator means in said housing means including a tubular assemblage defining a portion of said flow passage and movable with respect to said housing means between axially spaced positions respectively corresponding to a valve closed position, a valve open position, and a lock setting position;

said tubular assemblage cooperating with a portion of the bore of said tubular housing means to define an annular fluid pressure chamber;

an annular piston shoulder on said tubular assemblage slidable and sealably engaging the outer wall of said annular fluid pressure chamber and movable between said axially spaced positions in response to an increase in pressure of fluids in the well annulus externally of said housing means from the hydrostatic pressure level;

said tubular assemblage being movable from said valve closed position through said valve opening position to said lock setting position by said increase in pressure of fluids in the well annulus;

resilient means opposing movement of said tubular assemblage to said valve opening and lock setting position, whereby said tubular assemblage is biased toward said valve closed position by said resilient means upon reduction of said fluid pressure in the well annulus;

an internal sleeve disposed below said tubular sleeve and cooperating with the bore of said housing means to define a trap chamber for holding a pressurized gas;

floating piston means in the lower portion of said trap chamber for applying a predetermined well annulus pressure to the bottom end of said trap chamber, whereby a fluid pressure substantially in excess of the well hydrostatic pressure at the level of said isolated formation is trapped in said trap chamber;

conduit means for applying said pressurized gas to the lower face of said piston shoulder, thereby applying a substantial additional upward force to said tubular assemblage holding said valve in said closed position; and lock means operable by movement of said tubular assemblage from said lock setting position toward said valve closed position for securing said tubular assemblage in a valve open-locked position, said lock means being disposed between the exterior of said tubular assemblage and the bore of said housing means and comprising means for locking said tubular assemblage in said lock open position in response to movement of said tubular assemblage past said valve open position to said lock setting position, followed by a return of said tubular assemblage toward said valve closed position, and further comprising means for unlocking said tubular assemblage by subsequent movement of said tubular assemblage from said lock open position downwardly to a valve open fail safe position, said lock means further comprising an abutment sleeve rotatably mounted in said housing means and defining a plurality of peripherally spaced internal projections;

a plurality of peripherally spaced external projections on said tubular assemblage;

said internal and external projections being aligned and abuttable in one angular position of said abutment sleeve to lock said tubular assemblage in said valve open position and being misaligned and non-abuttable in another angular position of said abutment sleeve; and pin and slot means cooperable between said abutment sleeve and said tubular assemblage for controlling the angular position of said abutment sleeve as a function of the longitudinal movement of said tubular assemblage to and from said lock setting position and valve open-fail safe position.

2. A fluid pressure controlled apparatus having tubular housing means adapted to be connected to a pipe string and having an axial flow passage extending therethrough from an isolated well formation;

a valve mounted in said tubular housing means and shiftable between open and closed positions relative to said axial flow passage;

internal valve actuator means in said housing means including a tubular assemblage defining a portion of said flow passage and movable with respect to said housing means between axially spaced positions respectively corresponding to a valve closed position, and a valve open position;

said tubular assemblage cooperating with a portion of the bore of said tubular housing means to define an annular fluid pressure chamber;

an annular piston shoulder on said tubular assemblage slidable and sealably engaging the outer wall of said annular fluid pressure chamber and movable between said axially spaced positions in response to an increase in pressure of fluids in the well annulus externally of said housing means from the hydrostatic pressure level;

said tubular assemblage being movable axially from said valve closed position to said valve opening position by said increase in pressure of fluids in the well annulus;

resilient means opposing movement of said tubular assemblage to said valve opening position, whereby said tubular assemblage is biased toward said valve closed position by said resilient means upon reduction of said fluid pressure in the well annulus;

an internal sleeve disposed below said tubular sleeve and cooperating with the bore of said housing means to define a trap chamber for holding a pressurized gas;

floating piston means in the lower portion of said trap chamber;

trapping valve means for applying a predetermined well annulus pressure to the bottom end of said trap chamber, whereby a fluid pressure substantially in excess of the well hydrostatic pressure at the level of said isolated formation may be trapped in said trap chamber; and conduit means for applying said pressurized gas to the lower face of said piston shoulder, thereby applying a substantial additional upward force to said tubular assemblage holding said valve in said closed position;

a ball valve pivotally mounted in said tubular housing for movement between said open and closed positions;

said ball valve having an annular metallic sealing surface which faces downwardly in said closed position of said valve;

a seal sleeve operatively connected to said tubular assemblage below said ball valve; and said seal sleeve having an upwardly facing annular metallic seal surface sealingly engagable with said annular metallic seal surface on said ball valve in said valve closed position of said tubular assemblage, whereby elastomeric materials are eliminated from the dynamic ball seal, means defining a second annular fluid pressurechamber between the exterior of said tubular assemblage and the interior of said tubular housing means;

said second annular fluid pressure chamber being in communication with the fluid pressure existing above said ball valve when said ball valve is in its said closed position;

port means communicating between the bore of said tubular assemblage and said second annular fluid pressure chamber;

an annular floating piston sleeve slidably and sealably mounted in said second annular fluid pressure chamber in separating relationship to the fluid pressures respectively derived from above the closed ball valve and from below the closed ball valve;

said tubular assemblage having an external rib projecting into said second annular fluid pressure chamber and sealingly engaged with the inner surface of said annular floating piston sleeve, the downwardly facing area of said rib being exposed to said fluid pressure derived from above the closed ball valve and having a greater effective area acting on said tubular assemblage than the upwardly facing surfaces of said tubular assemblage exposed to said fluid pressure derived from above the closed ball valve resulting in a substantial force to maintain the sealing engagement of said annular metallic sealing surfaces.

3. Apparatus for opening and closing a well conduit extending to an isolated production formation comprising:

a ball valve;

means for pivotally mounting said ball valve within said conduit for movement between an open and a closed position relative to the conduit bore;

a tubular actuating assemblage slidably mounted within said conduit below said ball valve;

means secured to the top end of said actuating assemblage engagable with said ball valve to pivot said ball valve from a closed to an open position by downward movement of said actuating sleeve;

said ball having an external annular metallic sealing means disposed in downwardly facing relation when said ball valve is in said closed position;

an upwardly facing metallic seal ring formed on the top of said actuating sleeve and sealingly engagable with said annular metallic sealing means, whereby the fluid pressure above said ball may be higher or lower than the fluid pressure below said ball valve in its closed position;

means defining an annular fluid pressure chamber between the exterior of said actuating assemblage and the interior of said well conduit;

the top end of said annular fluid pressure chamber being in communication with the fluid pressure above said ball valve;

port means communicating between the bore of said actuating assemblage and said annular fluid pressure chamber, thereby supplying fluid pressure below said ball valve to said annular fluid pressure chamber;

an annular floating piston sleeve slidably and sealably mounted in said annular fluid pressure chamber in separating relationship to the fluid pressures respectively derived from above the closed ball valve and below the closed ball valve, said floating piston sleeve being abuttable with said actuating assemblage only when shifted upwardly by fluid pressure;

fluid pressure means for shifting said actuating assemblage downwardly to open said ball valve; and separate resilient means and hydraulic means opposing said downward movement and biasing said actuating assemblage upwardly to its ball valve closing position.

4. The apparatus of claim 3 wherein said actuating assemblage has an external rib projecting into said second annular fluid pressure chamber and sealingly engaged with the inner surface of said annular floating piston sleeve, the downwardly facing areas of said rib being exposed to said fluid pressure derived from above the closed ball valve and having a greater effective area than the upwardly facing surfaces of said actuating assemblage exposed to said fluid pressure derived from above the closed ball valve.

5. The apparatus cf claim 3 wherein said ball valve has a cam track on its periphery, and said means secured to the top end of said actuating sleeve comprises an internally projecting pin engagable with said cam track.

6. The apparatus of claim 5 wherein at least one end of said cam track is open, permitting said pin to move out of said cam slot by upward movement of said actuating assemblage beyond its valve closing position to engage said metallic seal ring with said annular metallic seal means subsequent to closing said ball valve, whereby downward movement of said actuating sleeve separates said metallic seal ring from said annular metallic seal means prior to any pivotal opening movement of said ball valve.

7. The apparatus of claim 5 wherein both ends of said cam track are open, permitting said pin to move out of said slot by upward movement of said actuating sleeve beyond its ball valve closing position, and also permitting downward movement of said actuating sleeve beyond its ball valve opening position.

8. The method of effecting the locking of a downhole well valve in an open position wherein the valve is pivoted in a tubular housing for movement between said positions by axial movements of a tubular actuator slidably mounted in the tubular housing and movable between two positions corresponding to the open and closed positions of the valve and also to a lock setting position, said tubular actuator having external locking lugs thereon and being movable through a rotatable, axially fixed locking ring having internal locking lugs thereon comprising the steps of:

controlling the angular position of said locking ring by a cycle of axial movements of said tubular actuator including (1) moving the tubular actuator beyond its valve open position to said lock setting position with the internal locking lugs angularly indexed to pass between said external locking lugs, and (2) returning the tubular actuator from said lock setting position to said valve open position to angularly index the internal locking lugs to block the path of said external lugs and prevent movement of said tubular actuator to its valve closed position.

9. The method of claim 8 further comprising repeating said cycle of axial movements of said tubular actuator to angularly index said locking ring to position said external lugs to pass through said internal lugs and permit movement of said tubular actuator to its valve closed position.

10. The method of claim 8 or 9 further comprising the step of producing the movements of said tubular actuator by changing the pressure of fluids external to said tubular housing.

* * * * *